US006095174A

United States Patent [19]

Miller

[11] Patent Number: 6,095,174

[45] Date of Patent: Aug. 1, 2000

[54] PORTABLE FIRE HYDRANT

[76] Inventor: Wayne Edwin Miller, 1113 Wheatland Ave., Lancaster, Pa. 17603

[21] Appl. No.: 09/294,508

[22] Filed: Apr. 20, 1999

Related U.S. Application Data

[62] Division of application No. 08/953,901, Oct. 20, 1997, Pat. No. 5,901,738.

[51] Int. Cl.[7] ..... F16K 31/50

[52] U.S. Cl. ..... 137/15; 137/272; 251/149.9

[58] Field of Search ..... 137/15, 272; 251/149.9

[56] References Cited

U.S. PATENT DOCUMENTS

| | | | |
|---|---|---|---|
| 192,062 | 6/1877 | Garratt . | |
| 543,773 | 7/1895 | Massey . | |
| 594,070 | 11/1897 | Fahr . | |
| 1,641,512 | 9/1927 | Van Hecke . | |
| 2,217,712 | 10/1940 | Steelman | 137/13 |
| 2,286,623 | 6/1942 | Kellaher et al. | 137/78 |
| 2,351,640 | 6/1944 | Scott et al. | 137/13 |
| 2,528,369 | 10/1950 | Jensen | 285/173 |
| 2,765,806 | 10/1956 | Webster | 251/149.9 X |
| 2,827,914 | 3/1958 | Alters | 137/364 |
| 3,024,613 | 3/1962 | Calciano | 61/12 |
| 3,070,115 | 12/1962 | Jester | 137/296 |
| 3,537,471 | 11/1970 | Houle | 137/370 |
| 3,752,179 | 8/1973 | Atkins et al. | 137/272 |
| 3,961,642 | 6/1976 | Thomas et al. | 137/272 |
| 4,037,664 | 7/1977 | Gibson | 169/15 |
| 4,064,902 | 12/1977 | Swenson | 137/370 |
| 4,139,931 | 2/1979 | Royce | 29/157.1 R |
| 4,178,816 | 12/1979 | Radice | 81/57.3 |
| 4,284,099 | 8/1981 | Rifat | 137/296 |
| 4,307,746 | 12/1981 | Rifat | 137/291 |
| 4,502,175 | 3/1985 | Hillis | 15/104.92 |
| 4,550,876 | 11/1985 | Kulesza et al. | 239/211 |

(List continued on next page.)

FOREIGN PATENT DOCUMENTS

| | | |
|---|---|---|
| 1313316 | 2/1993 | Canada . |
| 35 00 156 A1 | 9/1986 | Germany . |
| 39 28 035 A1 | 3/1990 | Germany . |
| 42 43 756 A1 | 7/1994 | Germany . |
| 196 38 029 A1 | 10/1997 | Germany . |
| 0408995 | 8/1974 | Russian Federation . |
| 2 093 927 | 9/1982 | United Kingdom . |

OTHER PUBLICATIONS

Mueller Co., Mueller® 5–1/4' Flush Type Fire Hydrant, Jul. 1990, 1 page.

Guardian™, Fire Hydrant Catalog FH–95, Kennedy Valve, Aug. 1995, 8 pages.

Mueller®, "Maintenance and Operating Instructions for the Improved Fire Hydrant", Mueller Co., Jan. 15, 1960, 1–8.

Rensselaer, "Fire Hydrant", American Waterworks Association, Standard Specifications, The Ludlow Valve Manufacturing Co., Inc., Bulletin G, Jun. 22, 1960, 5 pages.

*Primary Examiner*—Gerald A. Michalsky

*Attorney, Agent, or Firm*—Woodcock Washburn Kurtz Mackiewicz & Norris LLP

[57] ABSTRACT

An improved portable fire hydrant that can operate a water main valve disposed within a water main to produce water for fighting a fire by rotating a valve stem coupled to the water main valve includes an extension through which water can flow when the fire hydrant is coupled to the water main. The portable fire hydrant may also include a sealing mechanism disposed on the extension that seals the portable fire hydrant to the water main. A valve operator may also be coupled to the portable fire hydrant and attached to a valve rod that extends down through the extension of the portable fire hydrant. Disposed on the end of the valve rod may be a coupling mechanism for coupling the valve operator to the water main valve. When the portable fire hydrant is attached to the water main, the valve operator of the portable fire hydrant is coupled to the water main valve so that manipulation of the valve operator will cause the water main valve to reposition. This enables fire fighting water to be provided from the water main to the portable fire hydrant. The fire hydrant may also have an aligning mechanism for properly aligning the hydrant with the water main, and an attaching mechanism for rigidly attaching the fire hydrant to the water main.

22 Claims, 6 Drawing Sheets

U.S. PATENT DOCUMENTS

| | | | |
|---|---|---|---|
| 4,651,771 | 3/1987 | Borenstein et al. | 137/296 |
| 4,671,315 | 6/1987 | Gardner | 137/355.12 |
| 4,790,342 | 12/1988 | Segal | 137/68.1 |
| 4,815,345 | 3/1989 | Radice | 81/57 |
| 4,836,291 | 6/1989 | Owens et al. | 169/46 |
| 4,908,249 | 3/1990 | Lines | 428/36.9 |
| 5,201,338 | 4/1993 | McKeague | 137/238 |
| 5,237,925 | 8/1993 | Vogt et al. | 102/386 |
| 5,327,925 | 7/1994 | Ortel | 137/15 |
| 5,520,210 | 5/1996 | Barton | 137/15 |
| 5,540,284 | 7/1996 | Esposito et al. | 169/62 |
| 5,547,164 | 8/1996 | Ratnik et al. | 251/129.03 |
| 5,549,133 | 8/1996 | Sigelakis | 137/296 |
| 5,590,679 | 1/1997 | Almasy et al. | 137/218 |
| 5,596,893 | 1/1997 | Stehling et al. | 70/175 |
| 5,603,228 | 2/1997 | Barthold et al. | 62/303 |
| 5,622,202 | 4/1997 | Etter et al. | 137/272 |
| 5,803,110 | 9/1998 | Segal | 137/68.14 |
| 5,810,044 | 9/1998 | Saidi | 137/272 |

PORTABLE FIRE HYDRANT

CROSS-REFERENCE TO RELATED APPLICATIONS

This application is a divisional of and claims the benefit of the filing date of U.S. Pat. application Ser. No. 08/953,901 filed Oct. 20, 1997, now U.S. Pat. No. 5,901,738.

BACKGROUND OF THE INVENTION

This invention relates to an improved portable fire hydrant that can be transported by a fire department to a water main and connected to a water main to supply fire fighting water. This invention also relates to a method of coupling an improved portable fire hydrant to a water main and a method of fighting a fire with the improved portable fire hydrant.

Conventional fire hydrants are well known and are disposed above ground level on a water main that is located below ground level. Typically, they include a cast iron or rigid steel structure that is fastened to a water main. A plurality of connectors for connecting the fire hydrant to a fire hose are generally disposed on the fire hydrant. Furthermore, the fire hydrant may have a plurality of connectors for connecting the fire hydrant to a water main. In many instances, these connectors are bolts or other fasteners that rigidly affix the fire hydrant to the water main.

Conventional fire hydrants may also include a valve operator disposed on the fire hydrant. The valve operator is coupled through a valve stem to a water main valve disposed in the water main below ground level. This valve operator may be manipulated by using a wrench or a similar mechanism designed to operate with the valve operator.

While conventional fire hydrants have proven to be satisfactory for some purposes, they have some disadvantages. For instance, since they are constructed from cast iron and are disposed above ground, they present a safety hazard. By way of illustration, automobiles or other vehicles can strike the fire hydrant causing damage to either or both the vehicle and the fire hydrant. If the fire hydrant is damaged, water pressure in the water main may decrease. Potentially, a loss of water for fire fighting or other purposes may occur. Similarly, people can inadvertently come into contact with a fire hydrant and injure themselves.

Because conventional fire hydrants are generally disposed curb side on a side walk, they have several other disadvantages. For instance, the amount of parking space that is available, which is a concern in relatively large cities, is decreased by the presence of conventional fire hydrants. In colder regions, in addition to removing snow from the streets, snow must be removed from the area surrounding these curb side fire hydrants. In some areas, the snow may be significant enough to cover a fire hydrant. Flags or poles have to be attached to the fire hydrants in these regions so that they can be readily located. Furthermore, since conventional fire hydrants are accessible, they are often opened for recreational purposes, especially in higher temperature climates. If the fire hydrants are opened, the water pressure in the attached water main will decrease. This causes several problems. For example, either less water for fire fighting purposes and for normal business and household use may be available or the rate at which this water is supplied may be decreased. This problem is more pronounced in large cities in the hotter periods of the year.

Because of these disadvantages, it has been suggested in the past that a portable fire hydrant be used. Once such fire hydrant is disclosed in U.S. Pat. No. 3,752,179 (Atkins). A portable fire hydrant may be carried by a fire department and installed on a water main to provide fire fighting water. Since a portable fire hydrant is not rigidly installed, it can overcome some of the drawbacks of permanently installed conventional fire hydrants. For instance, since it is removable, it will not be contacted accidentally be either people or vehicles. Furthermore, since it is removable, it need not be disposed curb side. For example, it could be attached to a water main located in a variety of places, including the middle of a street. By changing the location of where the fire hydrant attaches to a water main, several advantages are achieved. The amount of parking space is increased. If the water main to which the fire hydrant is to be attached is in the street, snow need only be removed in the street and the need for snow removal around a curb side fire hydrant is eliminated. Moreover, the likelihood of tampering with the water main to supply water for recreational purposes may be reduced if the water main to which the fire hydrant is to be attached is disposed in the street.

This invention relates to an improved portable fire hydrant that can be transported by a fire department and installed relatively easily into a water main and thereby overcome some of the problems presented by conventional fire hydrants. This invention also relates to a method of coupling an improved portable fire hydrant to a water main and a method of using the improved portable fire hydrant.

SUMMARY OF THE INVENTION

The portable fire hydrant of this invention can be coupled to a water main to provide fire fighting water. This portable fire hydrant may have an extension through which water can flow when the fire hydrant is coupled to the water main. Disposed on the extension may be an attaching mechanism for attaching the extension to a water main.

The portable fire hydrant may further include a valve operator coupled to the extension and a rod disposed within the extension that is coupled to the valve operator. In addition, a coupling mechanism may be disposed on one end of the rod. This coupling mechanism can be mated to a valve stem disposed in the water main. The valve stem of the water main is connected to a valve disposed in the water main. This water main valve controls the flow of water through the water main. When mated to the valve stem of the water main, the coupling mechanism couples the water main valve to the valve operator of the portable fire hydrant. Thus, manipulation of the valve operator will change the position of the water main valve and thereby supply water to the portable fire hydrant.

Disposed on the portable fire hydrant may be a sealing mechanism that includes an o-ring that runs around a periphery of the extension. When the extension is inserted onto the water main, the o-ring is compressed against an inner surface of the water main to seal the fire hydrant to the water main.

The sealing mechanism of the portable fire hydrant may also include an annular skirt disposed around the extension. This annular skirt creates an annular space between the skirt and the extension. The water main may have a flange that slidably engages the annular space between the skirt and the extension and thereby mates the portable fire hydrant with the water main.

As mentioned above, the portable fire hydrant may further include an attaching mechanism. The attaching mechanism may include a plurality of spring loaded members disposed on the extension. These spring loaded members are spring loaded towards the interior of the extension. The water main may have a plurality of apertures that are capable of receiving the spring loaded members. In order to secure the fire hydrant to the water main, the spring loaded members are driven into the apertures. More particularly, the spring loaded members move in response to operation of the valve operator. As described above, when the fire hydrant is mated with the extension, the valve operator is coupled to the valve stem of the water main valve. As the valve stem rotates in response to operation of the valve operator, a larger diameter section of the valve stem contacts the spring loaded members and pushes them towards the outer portion of the extension and into the apertures of the water main and thereby affixes the portable fire hydrant to the water main.

In further detail, the valve stem of the water main may have a portion that has a gradually reducing diameter proximal to a portion that has a relatively larger diameter. The portion of the valve stem that has the gradually reducing diameter is mated with the spring loaded members when the portable fire hydrant is attached to the water main. In this position, the spring loaded members are spring loaded towards the interior of the portable fire hydrant. When the valve operator is manipulated and the valve stem rotates to open the water main valve, the larger diameter portion of the valve stem comes into contact with the spring loaded members. As this occurs, the larger diameter portion of the valve stem pushes the spring loaded members towards the exterior of the portable fire hydrant and into the apertures disposed within the water main valve and thereby attaches the portable fire hydrant to the water main.

The portable fire hydrant may also include an aligning mechanism for aligning the fire hydrant with the water main upon installation. This aligning mechanism ensures that the spring loaded members of the attaching mechanism are properly aligned with the apertures of the water main. In a preferred embodiment, the aligning mechanism includes a plurality of keys disposed on the periphery of the extension. These keys mate with grooves disposed on the water main when the fire hydrant is coupled to the water main.

According to another aspect of this invention, a water main may include a pipe that has a flanged end that can be mated to the portable fire hydrant. The water main may also have a water main valve disposed within the water main and a valve stem extending from the water main to the flanged end. Disposed on the end of the valve stem, that is opposite the end that has the valve, is a connector for coupling the valve stem to the valve operator disposed on the portable fire hydrant.

DETAILED DESCRIPTION OF PREFERRED EMBODIMENTS

Figure 1:
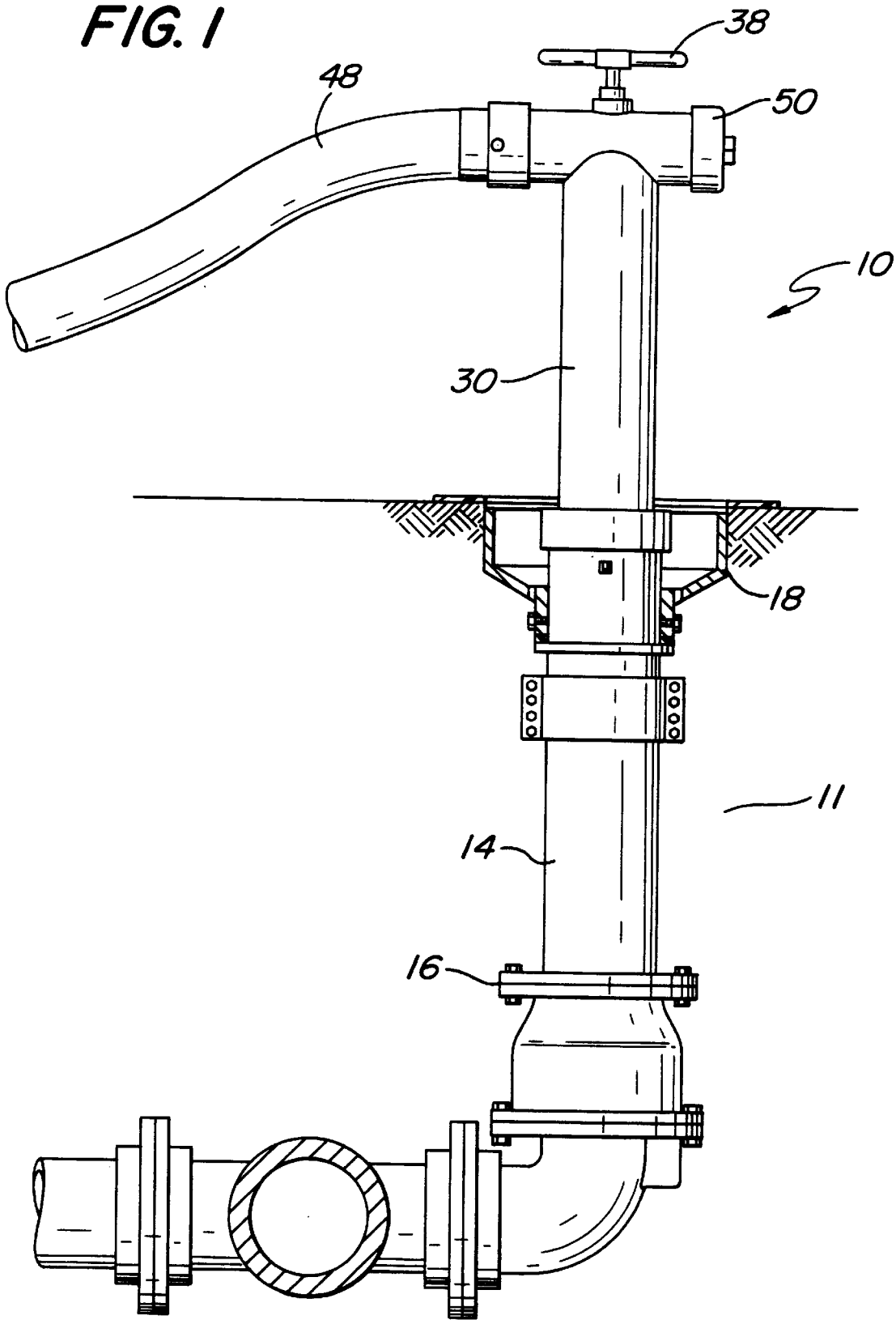
FIG. 1 depicts a portable fire hydrant connected to a water main according to a preferred embodiment of this invention.
Figure 2:
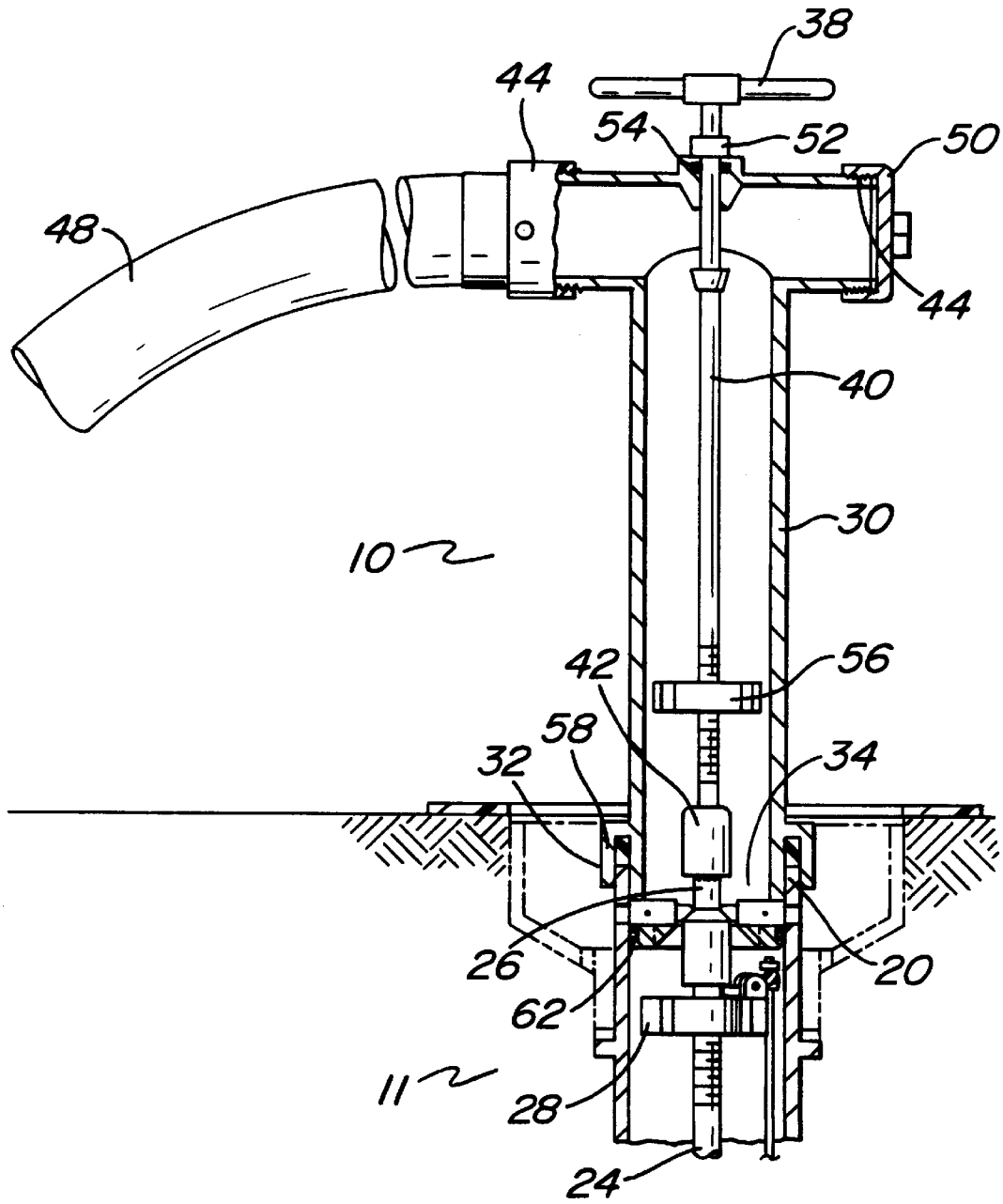
FIG. 2 is a cross-sectional view of a portion of the portable fire hydrant and water main of FIG. 1.

Referring now to the drawings, wherein like reference numerals designate corresponding structure throughout the views, and referring in particular to FIGS. 1 and 2, a portable fire hydrant 10 that can be transported by a fire hydrant and connected to a water main 11 is illustrated. This fire hydrant 10 can be transported relatively easily by a fire department and connected to the water main 11 to supply fire fighting water to extinguish a fire. FIGS. 1 and 2 illustrate the portable fire hydrant 10 connected to the water main 11. In comparison, FIG. 3 illustrates the water main 11 without the fire hydrant 10, and FIG. 3A illustrates a marker 12 or cover that can be disposed over the water main 11 when the fire hydrant 10 is not installed.

Figures 3, 3A:
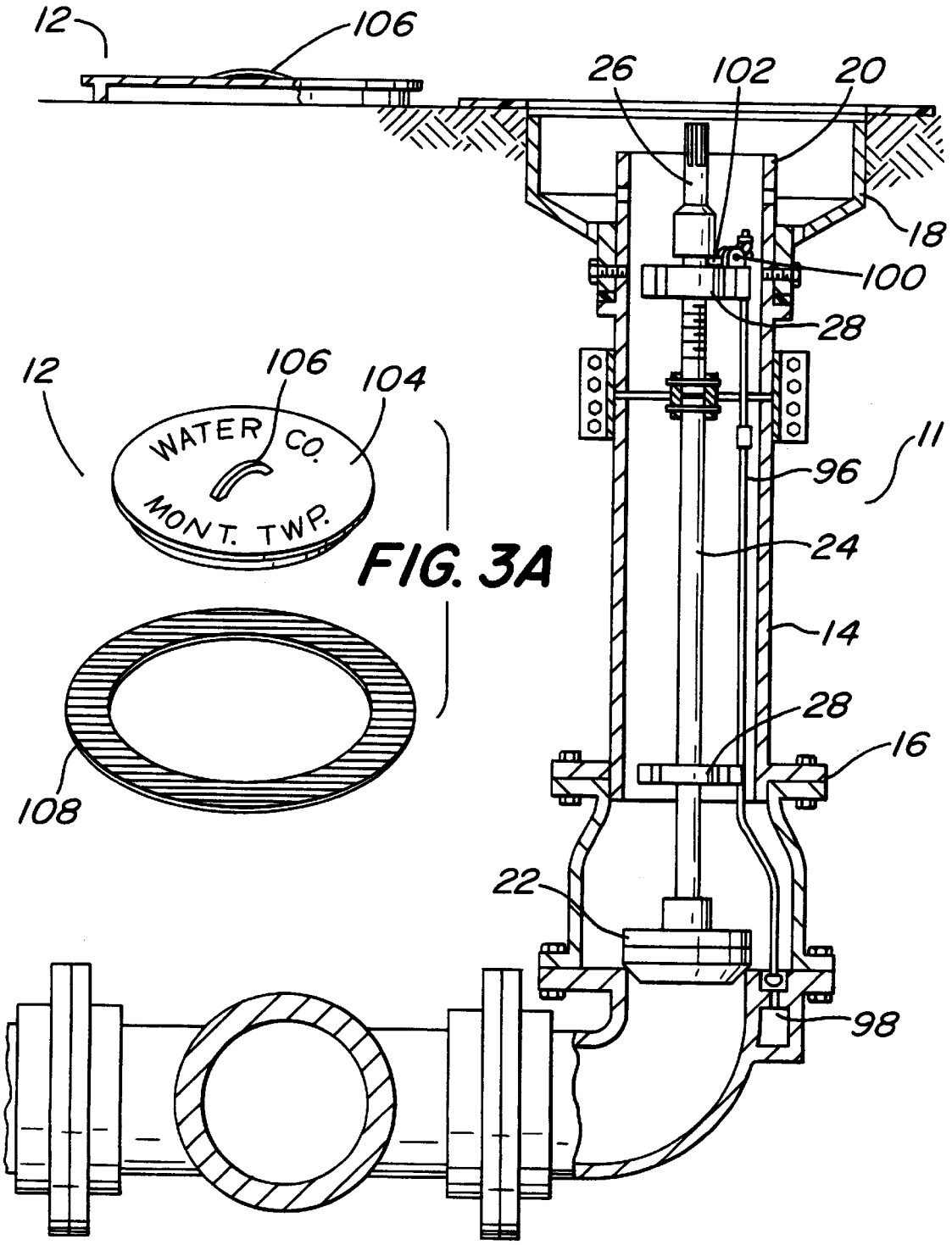
FIG. 3 is a cross-sectional view of the water main of FIG. 1.
FIG. 3A is an isometric view of a fire hydrant marker according to a preferred embodiment of this invention.

As is best seen in FIG. 3, the water main 11 includes a pipe 14 or a plurality of pipes that are connected through flanged joints 16. Bolts or other fasteners may be used to connect the flanged joints of the water main together. The water main 11, as shown in FIGS. 1 and 3, is disposed below ground level 17. The end of the water main 11 is disposed proximal to the ground level 17, and may have an outer flange 18 and an inner flange 20. The inner flange 20, as is described in detail below, is of a diameter and thickness such that it can be mated with the portable fire hydrant 10.

Figure 7:
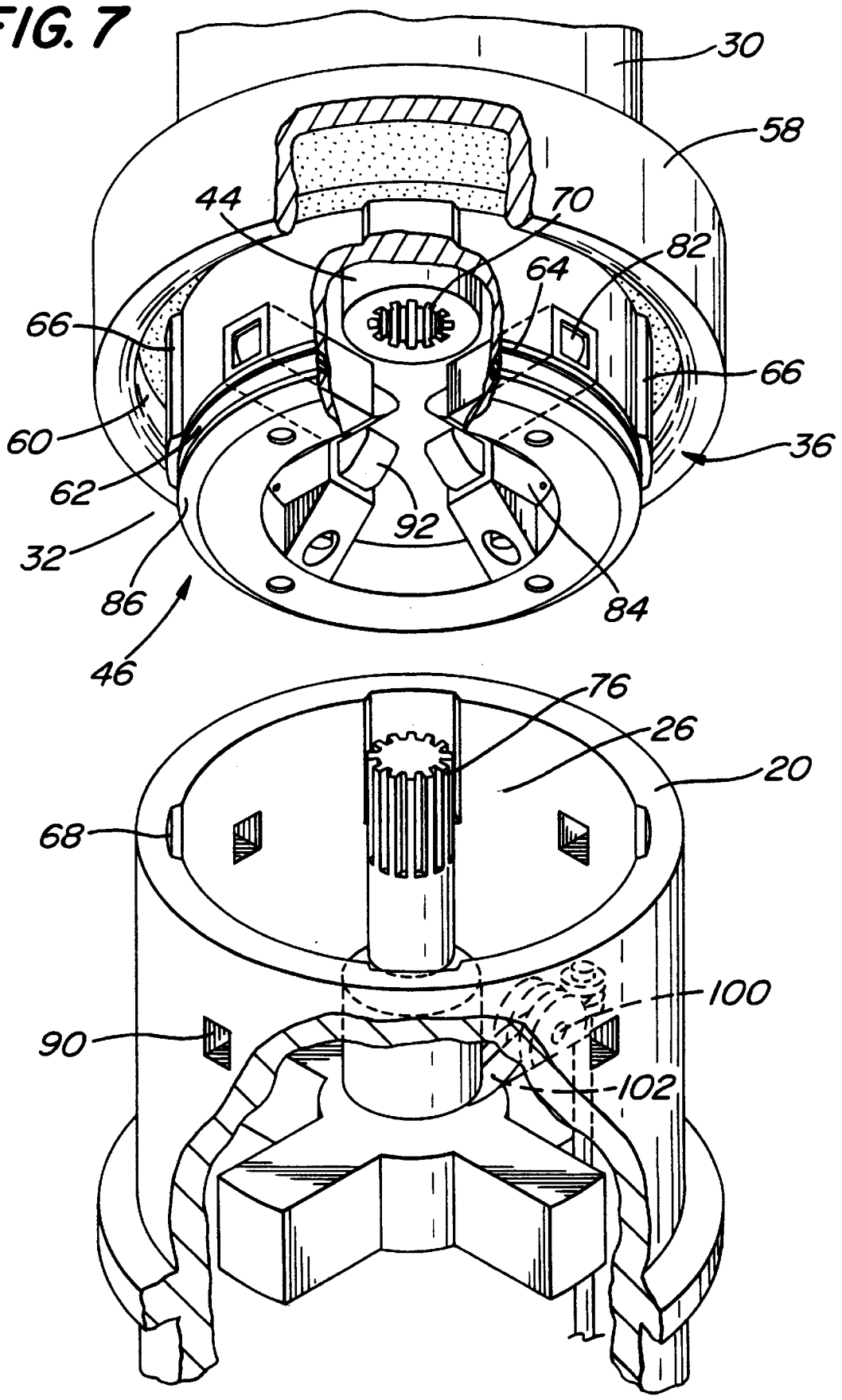
FIG. 7 is an isometric view of a portion of the fire hydrant and the water main of FIG. 1.

The water main 11 may further include a water main valve 22, a valve stem 24 and a connector 26. The valve 22 is disposed within the pipe 14 of the water main 11 and controls the flow of water through the water main 11. FIG. 3 illustrates the valve 22 in the closed position in which it prevents water flow. Coupled to the valve 22 is the valve stem 24. The valve stem 24 may be connected to the valve 22 by threaded connections or any one of a number of fastening techniques including, but not limited to, welding. Disposed on the other end of the valve stem 24 is a connector 26. This connector 26 is best depicted in FIG. 7 and is described in further detail below. The connector couples the valve 22 of the water main 11 to the portable fire hydrant 10. A stabilizer 28 may be disposed on the valve stem 24 to minimize bending of the valve stem 24 when the valve stem 24 is being manipulated. This stabilizer 28 may be attached to the valve stem 24 through welding or any one of a variety of fastening methods.

The concept of a water main 11 that has a valve stem 24, a water main valve 22, a pipe 14 and flanged joints 16 is not itself novel. However, these features of the water main 11 may be used in combination with other features of this invention.

Figure 4:
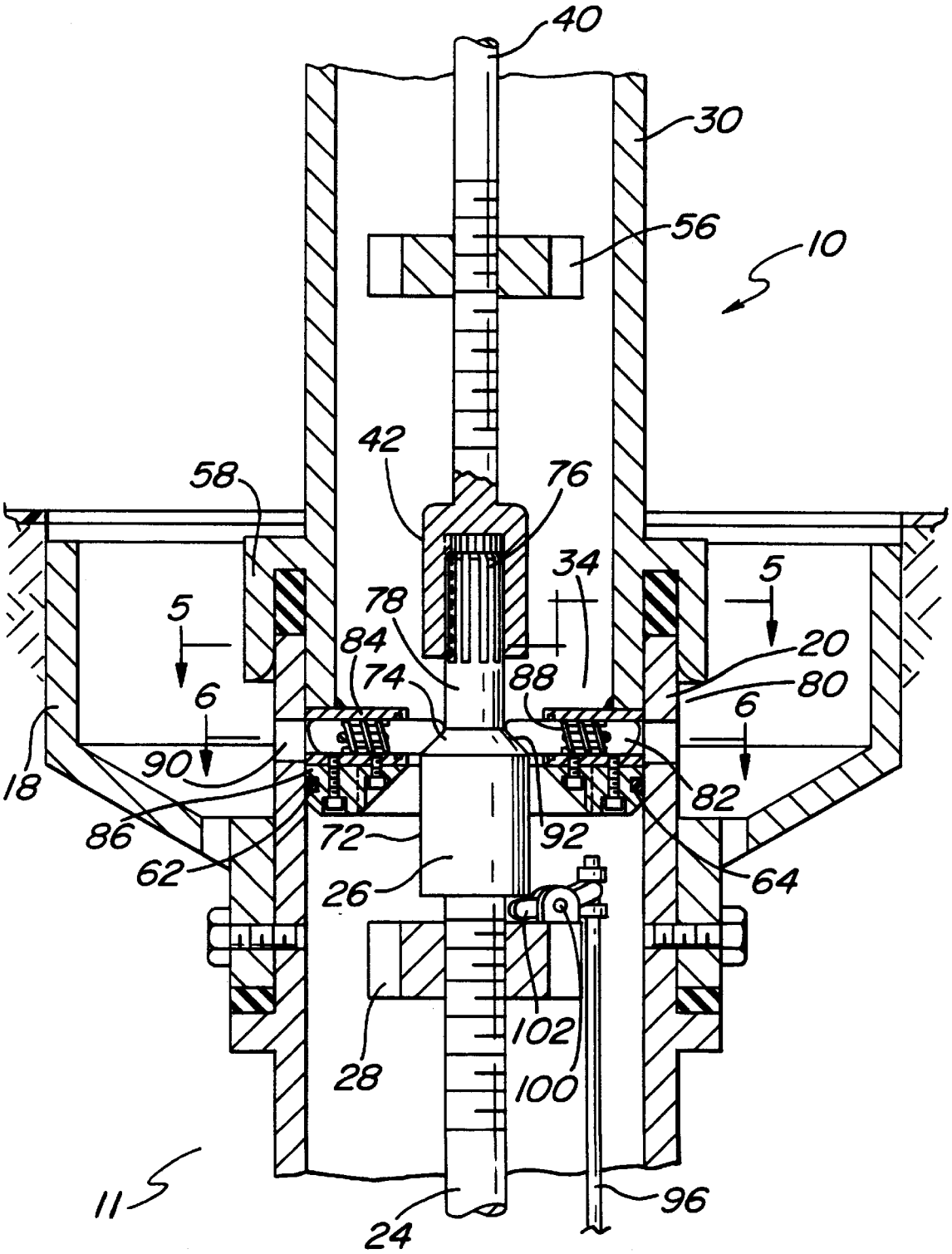
FIG. 4 is a cross-sectional view of the fire hydrant and the water main of FIG. 1.

According to a preferred embodiment of this invention, the portable fire hydrant 10 may include an extension 30, a sealing mechanism 32, an attaching mechanism 34, an aligning mechanism 36, a valve operator 38, a rod 40, a coupling mechanism 42 and connecting mechanisms 44. These features of the portable fire hydrant are shown in FIGS. 1, 2 and 4. The extension 30 forms the body of the portable fire hydrant. Preferably, the extension 30 is constructed from aluminum or another relatively light weight corrosion resistant material. By manufacturing the extension 30 from a relatively light weight material, the portable fire hydrant 10 can be transported relatively easily be a fire department. Furthermore, the lightweight characteristic of the portable fire hydrant 10 enables fire fighting personnel to manipulate it relatively easily when they are installing the fire hydrant.

In a preferred embodiment of this invention the extension 30 is formed in a shape of a "T." This invention is not limited to such a shape, and the extension 30 may have any one of a variety of shapes. The extension 30 may have an open end 46 for attaching to a water main 11. Disposed on either end of the upper part of the T of the extension 30 are the connecting mechanisms 44. Preferably, the connecting mechanisms 44 each include a threaded portion of the extension 30. These connecting mechanisms 44 may be used to attach the portable fire hydrant 10 to a fire hose 48 or other fire fighting equipment. As shown in FIGS. 1 and 2, a fire hose 48 can be coupled to the extension 30 by connecting the hose 48 to the connecting mechanism 44. It will be appreciated that other connecting mechanisms 44 may be employed depending on the type of apparatus to be connected with the fire hydrant 10. Furthermore, although two connecting mechanisms 44 are illustrated, the fire hydrant 10 may have any number of connecting mechanisms 44.

Disposed on each of the connecting mechanisms 44 may be a cap 50. The cap 50 functions to prevent or minimize mechanical damage and corrosion to the connecting mechanism 44. Although FIGS. 1 and 2 illustrate a cap 50 disposed on only one of the connecting mechanisms 44, a similar cap 50 can be disposed on the other connecting mechanism 44. Threaded connections or the like may be used to attach the caps 50 to the portable fire hydrant 10. The caps 50 may be connected to the connecting mechanisms 44 of the portable fire hydrant 10 when the portable fire hydrant 10 is attached to the water main 11 but when no hoses or equipment are connected to the fire hydrant 10. Similarly, these caps 50 may be installed on the connecting mechanisms 44 when the fire hydrant 10 is not installed on a water main 11.

As shown in FIGS. 1 and 2, the portable fire hydrant 10 has a valve operator 38. This valve operator 38 protrudes from the top of the extension 30 and can be used to manipulate a valve 22 disposed in the water main 11 and supply water when the fire hydrant 10 is attached to the water main 11. Although in the embodiment illustrated the valve operator 38 is disposed on the top of the extension 30, it may be disposed in a variety of locations on the extension 30. In a preferred embodiment of this invention, the valve operator 38 is a rotatable wheel. Preferably, the valve operator 38 can be manipulated by hand. However, the valve operator 38 may be of the type that requires a tool in order to manipulate it.

A bushing 52 and an o-ring 54 may be disposed between the valve operator 38 and the extension 30. The bushing 52 and the o-ring 54 seal the opening in the extension 30 through which the valve operator 38 extends and thereby prevent water flow through this opening.

Connected to the valve operator 38 is a rod 40. The rod 40 extends from the valve operator 38 down through the extension 30 to the open end of the extension 30. Disposed on the rod 40 may be a stabilizer 56. Preferably, the stabilizer 56 is connected to the rod 40 with threads as shown in FIG. 2. The stabilizer 56 functions to prevent or minimize bending of the rod 40 when the water main valve 22 is being manipulated by rotation of the valve operator 38, as described below. Disposed on the end of the rod 40 may be a coupling mechanism 42, as is best shown in FIG. 7, that may be used to couple the valve operator 38 and the rod 40 to the water main 11. The coupling mechanism 42 and its function are described in further detail below.

As mentioned above and as is best shown in FIGS. 2, 4 and 7, the portable fire hydrant 10 preferably includes a sealing mechanism 32. This sealing mechanism 32 may include an annular skirt 58 which extends around the periphery of the extension 30 of the portable fire hydrant 10. Formed in between the annular skirt 58 and the extension 30 is an annular space 60. The width of the annular space 60 is preferably approximately the same as the thickness of the inner flange 20 of the water main 11. Therefore, in order to install the portable fire hydrant 10 to the water main 11, the portable fire hydrant 10 is placed on the water main 11 so that the inner flange 20 fits within the annular space 60.

The sealing mechanism 32 of the portable fire hydrant 10 may include an o-ring 62 that is disposed in an o-ring groove 64 as is best shown in FIGS. 3, 4 and 7. The o-ring groove 64 runs around the periphery of the open end of the extension 30. The o-ring 62 is preferably constructed from an elastomeric type material. As is best shown in FIGS. 2 and 4, when the portable fire hydrant 10 is connected to the water main 11, the o-ring 62 is compressed by the inner flange 20 of the water main 11 in the o-ring groove 64. By preventing water flow between the extension 30 and the water main 11, the compressed o-ring seals these components together.

In order to ensure that the portable fire hydrant 10 is properly aligned with the water main 11, the fire hydrant 10 may have an aligning mechanism 36. The aligning mechanism 36 may include a plurality of keys 66 disposed along the extension 30 proximal to the annular space 60. These keys 66 are best shown in FIG. 7. Disposed on the inner portion of the inner flange 20 of the water main 11 are a plurality of grooves 68 which correspond to the keys 66. These grooves 68 are also best illustrated in FIG. 7. As is evident from FIG. 7, when the portable fire hydrant 10 is installed to the water main 11 the keys 66 slide into the groves 68. As will become apparent from the discussion below, it is important to properly align the fire hydrant 10 with the water main 11 so that these structures will be properly attached.

Figure 5:
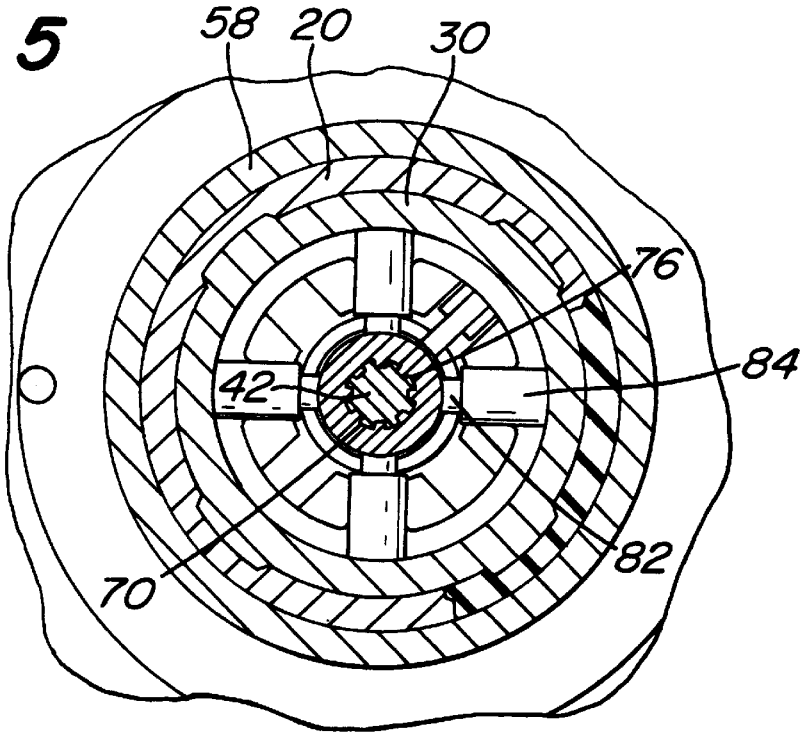
FIG. 5 is a cross-sectional view taking along line 5—5 of FIG. 4.

As alluded to above, the portable fire hydrant 10 has a coupling mechanism 42 disposed on the end of the rod 40. The coupling mechanism 42 is best shown in FIGS. 2, 4, 5 and 7. The coupling mechanism 42 may take the shape of a cap that has a hollow interior. As is shown in FIGS. 4, 5 and 7 the interior of the coupling mechanism 42 may have a plurality of slots 70. These slots 70 extend longitudinally along the interior of the coupling mechanism 42.

The coupling mechanism 42 of the portable fire hydrant 10 operates in conjunction with the connector 26 of the water main 11 in order to connect the valve operator 38 of the fire hydrant 10 to the valve 22 of the water main 11. In order to connect these components, the connector 26 may have in addition to a larger diameter section 72 and a gradually reducing diameter section 74, a plurality of raised members 76 disposed on a smaller diameter section 78. These raised members 76 extend longitudinally along the connector 26. The raised members 76 are of a width such that they can slidably engage the slots 70 of the coupling mechanism 42 of the portable fire hydrant 10. This is best illustrated in FIGS. 4 and 7.

In order to install the fire hydrant 10 to the water main 11, the coupling mechanism 42 must be properly aligned with the connector 26 so that the slots 70 of the coupling mechanism 42 can receive the raised members 76 of the connector 26. When connected, the valve operator 38 becomes coupled to the valve 22. The coupling mechanism 42 and the connector 26 may have a variety of embodiments depending on the type of fastening technique employed.

Figure 6:
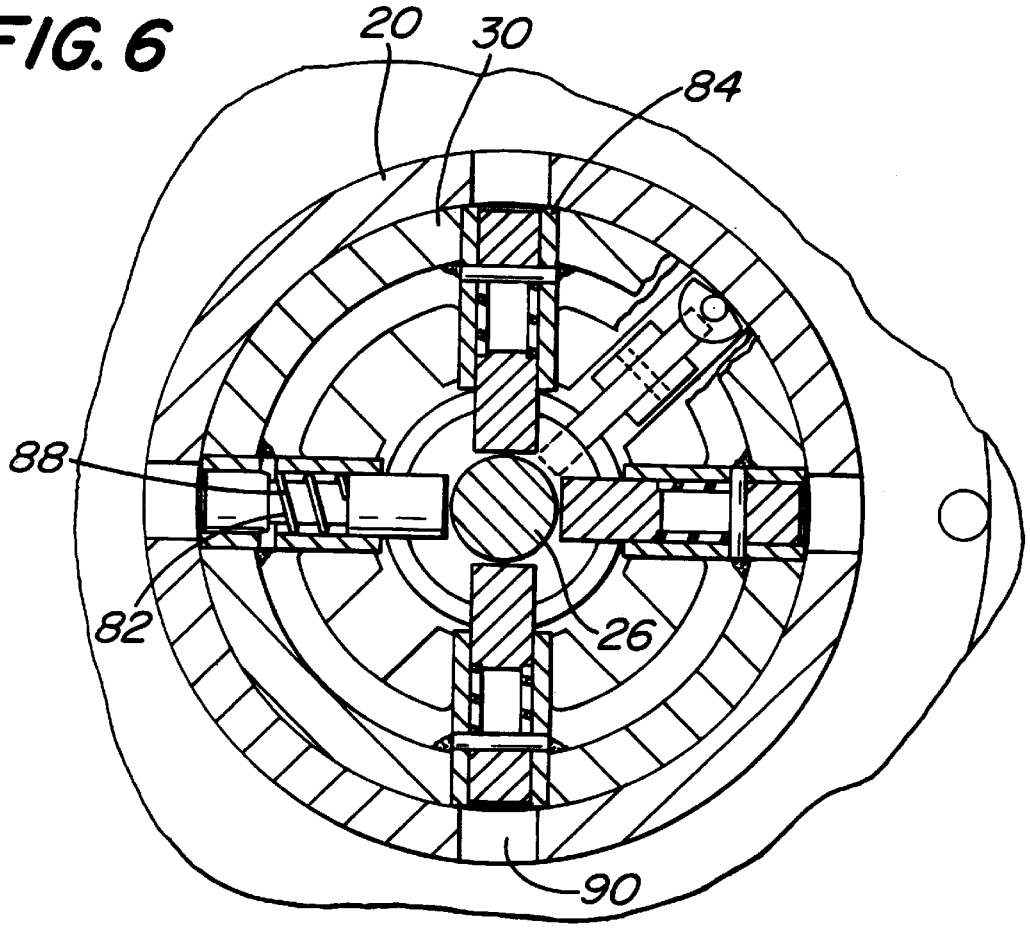
FIG. 6 is a cross-sectional view along line 6—6 of FIG. 4.

The portable fire hydrant 10 may further include an attaching mechanism 34 that has a support structure 80 for supporting a plurality of spring loaded members 82, as is best seen in FIGS. 4, 6 and 7. This support structure 80 may include a plurality of holders 84 that are connected to the extension 30. Preferably, the holders 84 are connected to the extension 30 through welding or other fastening techniques. The holders 84 may further include a ring 86 that is connected to the holders 84. The ring 86 is preferably connected to the holders 84 with bolts, threaded fasteners or the like. Each of the holders 84 retains one of the spring load members 82 as is shown in FIG. 4, and each of the spring loaded members 82 has a spring 88 disposed around its exterior.

The spring loaded members 82 are preferably spring loaded towards the interior of the extension 30. FIGS. 2, 4 and 6 show the spring loaded members 82 in their spring loaded position towards the interior of the extension 30. These spring loaded members 82 operate in conjunction with the water main 11 to rigidly affix the portable fire hydrant 10 to the water main 11. In particular, the water main 11 has a corresponding number of apertures 90 in its inner flange 20, as is best shown in FIGS. 6 and 7. Each of these apertures 90 can receive one of the spring loaded members 82.

The spring loaded members 82 may include a tapered end 92 that is disposed on the end of the spring loaded member 82 that points towards the interior of the extension 30. This tapered end 92 operates in conjunction with the connector 26 of the water main 11 to attach the fire hydrant 10 to the water main 11.

The connector 26 may include, as described above, a section 72 that has a large diameter and a section 74 which has a gradually reducing diameter. The gradually reducing diameter section 74 conforms to the tapered end 92 of the spring loaded members 82. When the fire hydrant 10 is initially installed on the water main 11, the spring loaded members 82 are in the unloaded position and their tapered end 92 rests against the gradually reduced diameter section 74. When the valve 22 is opened the larger diameter section 72 comes into contact with the tapered end 92 of the spring loaded members 82 and drives the spring loaded members 82 against spring pressure into the apertures 90 to a spring loaded position. With the spring loaded members 82 installed into the apertures 90, the fire hydrant 10 becomes rigidly attached to the water main 11.

In further detail, the attaching mechanism 34 operates as follows in conjunction with the valve stem 24 of the water main 11 to affix the fire hydrant 10 to the water main 11. When installed with the valve 22 of the water main 11 closed, the spring loaded members 82 remain in their spring loaded position, as shown in FIGS. 2 and 4. If the valve operator 38 of the portable fire hydrant 10 is manipulated, the valve 22 opens and the valve stem 24 connected to the valve 22 rises. As the valve stem 24 rises, the connector 26 pushes the spring loaded members 82 towards the exterior of the portable fire hydrant 10 and into the apertures 90 of the water main 11. In this raised position and with the valve 22 open, the connector 26 holds the spring loaded members 82 in the apertures 90. This prevents further movement of the portable fire hydrant 10 and connects the fire hydrant 10 to the water main 11 in a sealed fashion.

As described, as the fire hydrant 10 is attached to the water main 11 by the spring loaded members 82, the water main valve 22 is opened. Thus, as the components become attached, water is also being supplied through the water main valve 22 to the fire hydrant 10. Both of these functions are accomplished by simply manipulating the valve operator 38. Thus, manipulation of the valve operator 38 performs two functions. This is advantageous because it decreases the amount of operations that must be performed to attach the fire hydrant 10 to the water main 11 and to supply fire fighting water. Potentially, this decreases the amount of time it takes to install the fire hydrant 10 and supply fire fighting water.

In order to remove the fire hydrant 10 from the water main 11, the valve operator 38 is again manipulated to move the valve stem 24 of the water main 11 downward. As the valve stem 24 is manipulated in the reverse direction, the larger diameter section 72 of the connector 26 moves away from the spring loaded members 82, and the gradually reducing diameter section 74 of the valve stem 24 moves proximal to the tapered end 92 of the spring loaded members 82. The springs 88 bias the spring loaded members 82 to move in the inward direction out of the apertures 90 and into contact with the gradually reducing diameter section 74. Once the spring loaded members 82 are removed from the apertures 90, the fire hydrant 10 can be removed from the water main 11. As the valve operator 38 is manipulated, the valve stem 24 and the rod 40 are rotated. Therefore, the water main valve 22 is also repositioned to the closed position as the spring loaded members 82 move to their unloaded position. Again, manipulation of the valve operator 38 performs two functions, disconnecting the fire hydrant from the water main 11 and closing the water main valve 22. This potentially decreases the amount of time needed to disconnect the fire hydrant 10 from the water main 11.

It will be appreciated that in order for the spring loaded members 82 to be inserted into the apertures 90, they must be properly aligned with the apertures 90. Proper alignment of these components is achieved by aligning the keys 66 of the fire hydrant 10 with the grooves 68 of the water main 11, as described above. The spring loaded members 82 and the apertures 90 of the water main 11 are positioned so that they will be aligned if the keys 66 and grooves 68 are properly aligned. Thus, the aligning mechanism 36 ensures that the fire hydrant 10 is installed at a selected orientation relative to the water main 11 in order to properly align the spring loaded members 82 of the fire hydrant 10 with the apertures 90 of the water main 11.

The water main 11 may include a frost protection valve 94, a linkage 96, a drain 98, a rotatable pin 100, and a finger 102. These components function to prevent water from accumulating in the section of pipe 14 disposed above the valve 22 when the valve 22 is closed and thereby preventing water from freezing within this section of the pipe. The concept of a frost protection valve is not knew and is discussed in U.S. Pat. No. 4,307,746 (Rifat). However, the frost protection valve 94 may be used in combination with other components of this invention.

The frost protection valve 94 is disposed above the drain 98. The drain 98 functions to permit water to flow from the pipe 14 through the drain 98 when the frost protection valve 94 is open. The frost protection valve 94 is connected to the stabilizer 56. Rotatably mounted on the stabilizer 56 is the pin 100. The finger 102 is rotatably mounted to the pin 100 to rotate about the longitudinal axis of the pin 100. The frost protection valve 94 is connected to the rotatable pin 100 by the linkage 96 on the side of the pin 100 opposite the side to which the finger 102 is connected. The weight of the linkage 96 and the valve 94 biases the pin 100 to rotate in a clockwise direction, as shown in FIGS. 3 and 4.

When the valve 22 is in the closed position, the connector 26 rests against the finger 102 and causes it to rotate in the counterclockwise direction. The connector 26 also holds the finger 102 in a rotated position as shown in FIG. 3, when the valve 22 is closed. When the pin 100 and the finger 102 are rotated in the counterclockwise direction, the attached frost protection valve 94 is lifted from the drain 98. This permits water to flow from the pipe 14 to the drain 98. Thus, when the valve 22 is in the closed position the frost protection valve 94 is open and water is permitted to drain from the pipe 14 and freezing of water in the pipe is thereby prevented.

When the valve 22 is moved to the open position, it moves away from the valve seat. As the valve 22 rises, the attached valve stem 24 and connector 26 also rise. As the connector 26 rises, it releases the finger 102. The weight of the linkage 96 and the frost protection valve 94 cause the finger 102 to rotate with the pin 100 in the clockwise direction. As the pin 100 rotates, it causes the connected frost protection valve 94 to contact the drain 98 and thereby prevent water flow through the drain 98. Thus, when the valve 22 moves to the open position the frost protection valve 94 is closed. This prevents water from flowing out the drain 98 when the valve 22 is opened to supply water for fire fighting purposes.

In comparison, when the valve 22 is moved to the closed position, the connector 26 moves downward. As the connector 26 moves downward, it contacts the finger 102 and causes the pin 100 to rotate. Rotation of the pin causes the frost protection valve 94 to open. When the frost protection valve 94 is opened, the water main valve 22 is closed.

As described above, manipulation of the valve operator 38 performs two functions, operation of the attaching mechanism 34 and operation of the water main valve 22. Since movement of the valve operator 38 causes the valve 22 to be operated, manipulation of the valve operator 38 also causes the frost protection valve 94 to move between an open and a closed position. Thus, manipulation of the valve operator 38 also performs a third function. Although, as mentioned above the frost protection valve 94 itself is not novel, the concept of a valve operator 36 in a fire hydrant 10 that performs these three functions when manipulated is believed to be novel.

In order to protect the water main 11 when the portable fire hydrant 10 is not installed, a marker 12 or cover may be installed over the water main 11. This marker 12 is illustrated in FIGS. 3 and 3A. The marker 12 has two sections, an inner section 104 and an outer section 106. The inner section 104 is preferably constructed from metal or a similar material. A handle 108 may be disposed on this inner section 104 so that it may be easily removed from the water main 11. Disposed on the inner section 104 may be the name of the principality that is responsible for the water main 11. Disposed around the inner section 104 is the outer section 106 which is preferably a ring of elastomeric material. The outer section 106 may be attached to the inner section 104 by an adhesive or by any of a number of fastening methods. Inscribed on the outer section of 106 may be a trademark of the manufacturer of the marker 12. This outer section 106 may be color coded. For example, it may be coded blue to indicate that there is water below the marker 12 or red to indicate that it is for fire fighting.

In summary, the portable fire hydrant 10 can be installed to the water main 11 by first using the aligning mechanism to properly orient the fire hydrant 10 and the water main 11. Once properly aligned, the fire hydrant 10 can be placed onto the water main 11. This includes sliding the inner flange 20 of the water main 11 into the annular space 60 of the fire hydrant 10, and sliding the coupling mechanism 42 attached to the valve operator 38 over the connector 26 attached to the water main valve 22. As the fire hydrant 10 and the water main 11 are slid together, the sealing mechanism 32 functions to seal the periphery of the extension 30 to the water main 11. In order to rigidly attach the fire hydrant 10 to the water main 11, supply fire fighting water to the fire hydrant 10 and shut the frost protection valve 94, the valve operator 38 is manipulated. Thus, by merely aligning the fire hydrant 10 with the water main 11, sliding them together and manipulating the valve operator 38, water can be supplied from the water main to the fire hydrant.

As discussed above, in a preferred embodiment of this invention, the water main 11 is disposed below the ground level 17, and the fire hydrant 10 is portable. This is advantageous because the water main 11 may be disposed in a variety of locations. For instance, the water main 11 may be disposed in a road, as opposed to a sidewalk. As discussed above, this has several advantages, including the fact that with the water main 11 disposed in the street, parking restrictions due to fire hydrants disposed on sidewalks are eliminated. In addition, in areas in which snow is a concern, the snow covering the water main be will removed when the roads are plowed. This is advantageous because it eliminates the extra maintenance required to remove snow that builds up around a fire hydrant that is disposed curb side. Moreover, this may make it more difficult to tamper with the water main 11 and cause water pressure in the water main to be reduced.

It is to be understood, however, that even if numerous characteristics and advantages of the present invention have been set forth in the foregoing description, together with details of the structure and function of the invention, the disclosure is illustrative only, and changes may be made to detail, especially in matters of shape, size and arrangement of parts within the principles of the invention to the full extent indicated by the broad general meaning of the terms in which the appended claims are expressed.

What is claimed is:

1. A method of coupling a portable fire hydrant to a water main that has a water main valve coupled to a valve stem, comprising:

aligning an extension that forms at least part of a body of the portable fire hydrant with the water main;

attaching the portable fire hydrant to the water main by manipulating a valve operator, disposed on the extension, and thereby causing an attaching mechanism, disposed on the extension, to attach the portable fire hydrant to the water main; and coupling the valve operator to the valve stem and thereby coupling the valve operator to the water main valve, so that manipulation of the valve operator causes operation of the water main valve.

2. The method of claim 1, further comprising sealing the portable fire hydrant to the water main.

3. The method of claim 2, wherein sealing comprises sliding the extension into the water main so that a seal is created between the extension and the water main.

4. The method of claim 3, wherein the seal is created between an elastomeric material running around a periphery of the extension and the water main.

5. The method of claim 1, wherein the attaching mechanism comprises a plurality of spring loaded members disposed on the extension that are spring loaded towards an interior of the extension and that can be pushed towards the exterior of the extension in response to manipulation of the valve operator and inserted into apertures in the water main.

6. A method of coupling a portable fire hydrant to a water main that has a water main valve coupled to a valve stem, comprising:

aligning an extension that forms at least part of a body of the portable fire hydrant with the water main; and mechanically connecting a valve operator, disposed on the extension, to the valve stem and thereby mechanically connecting the valve operator to the water main valve, so that manipulation of the valve operator causes operation of the water main valve.

7. The method of claim 6, further comprising sealing the portable fire hydrant to the water main.

8. The method of claim 7, wherein sealing comprises sliding the extension into the water main so that a seal is created between the extension and the water main.

9. The method of claim 8, wherein the seal is created between an elastomeric material running around a periphery of the extension and the water main.

10. The method of claim 6, further comprising attaching the extension of the fire hydrant to the water main.

11. The method of claim 10, wherein the portable fire hydrant further comprises a plurality of spring loaded members disposed on the extension that are spring loaded towards an interior of the extension and that can be pushed towards the exterior of the extension in response to manipulation of the valve operator and inserted into apertures in the water main and attaching further comprises manipulating the valve operator to push the spring loaded members so that they are pushed into corresponding apertures in the water main to thereby attach the fire hydrant to the water main.

12. The method of claim 6, wherein the fire hydrant further comprises a rod coupled to the valve operator at a first end and to a cap at a second end, and mechanically connecting comprises connecting the cap to the valve stem of the water main, so that manipulation of the valve operator will manipulate the rod and the cap and thereby manipulate the valve stem and the valve operator.

13. The method of claim 12, wherein the manipulation of the valve operator comprises rotating the valve operator.

14. The method of claim 6, wherein the manipulation of the valve operator comprises rotating the valve operator.

15. A method of coupling a portable fire hydrant to a water main that has a water main valve coupled to a valve stem, comprising:

aligning an extension that forms at least part of a body of the portable fire hydrant with the water main;

inserting the extension into the water main;

mechanically connecting a valve operator, disposed on the extension, to the valve stem and thereby mechanically connecting the valve operator to the water main valve, so that manipulation of the valve operator causes operation of the water main valve; and attaching the extension of the fire hydrant to the water main.

16. The method of claim 15, further comprising sealing the portable fire hydrant to the water main.

17. The method of claim 15, wherein sealing comprises sliding the extension into the water main so that a seal is created between the extension and the water main.

18. The method of claim 17, wherein the seal is created between an elastomeric material running around a periphery of the extension and the water main.

19. The method of claim 15, wherein the portable fire hydrant further comprises a plurality of spring loaded members disposed on the extension that are spring loaded towards an interior of the extension and that can be pushed towards the exterior of the extension in response to manipulation of the valve operator and inserted into apertures in the water main and attaching further comprises manipulating the valve operator to push the spring loaded members so that they are pushed into corresponding apertures in the water main to thereby attach the fire hydrant to the water main.

20. The method of claim 15, wherein the fire hydrant further comprises a rod coupled to the valve operator at a first end and to a cap at a second end, and mechanically connecting comprises connecting the cap to the valve stem of the water main, so that manipulation of the valve operator will manipulate the rod and the cap and thereby manipulate the valve stem and the valve operator.

21. The method of claim 20, wherein the manipulation of the valve operator comprises rotating the valve operator.

22. The method of claim 15, wherein the manipulation of the valve operator comprises rotating the valve operator.

* * * * *